US007144008B2

(12) United States Patent
Suzuki

(10) Patent No.: US 7,144,008 B2
(45) Date of Patent: Dec. 5, 2006

(54) SHEET FEEDING APPARATUS AND IMAGE FORMING APPARATUS

(75) Inventor: Nobutaka Suzuki, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/246,210

(22) Filed: Oct. 11, 2005

(65) Prior Publication Data

US 2006/0033263 A1 Feb. 16, 2006

Related U.S. Application Data

(62) Division of application No. 10/403,011, filed on Apr. 1, 2003, now Pat. No. 7,073,789.

(30) Foreign Application Priority Data

Apr. 11, 2002 (JP) ..... 2002-108753

(51) Int. Cl.
*B65H 7/02* (2006.01)

(52) U.S. Cl. ..... 271/265.04; 271/265.02; 271/265.01

(58) Field of Classification Search ..... 271/110, 271/145, 152, 265.04, 262, 265.01, 265.02; 250/559.27, 559.28
See application file for complete search history.

(56) References Cited

U.S. PATENT DOCUMENTS

| | | | |
|---|---|---|---|
| 3,725,667 | A | 4/1973 | Schwartz |
| 3,869,211 | A | 3/1975 | Watanabe et al. |
| 4,605,848 | A | 8/1986 | Ogawa |
| 4,778,986 | A | 10/1988 | Lundberg et al. |
| 4,937,460 | A | 6/1990 | Duncan et al. |
| 4,983,854 | A | 1/1991 | Mizuno et al. |
| 5,067,704 | A | 11/1991 | Tsuihiji et al. |
| 5,138,178 | A | 8/1992 | Wong et al. |
| 5,139,339 | A | 8/1992 | Courtney et al. |
| 5,283,424 | A | 2/1994 | Acquaviva et al. |
| 5,365,084 | A | 11/1994 | Cochran et al. |
| 5,502,312 | A | 3/1996 | Lorenzo |
| 5,808,295 | A | 9/1998 | Takeda et al. |
| 5,971,392 | A | 10/1999 | Lee |
| 6,082,732 | A | 7/2000 | Hutchison et al. |

(Continued)

FOREIGN PATENT DOCUMENTS

JP 56142038 A * 11/1981

(Continued)

OTHER PUBLICATIONS

Patent Abstracts of Japan, JP 01-308322, Dec. 13, 1989.

(Continued)

*Primary Examiner*—Patrick Mackey
*Assistant Examiner*—Matthew J. Kohner
(74) *Attorney, Agent, or Firm*—Oblon, Spivak, McClelland, Maier & Neustadt, P.C.

(57) ABSTRACT

An image forming apparatus includes a sheet tray configured to accommodate stacked sheets and a sheet feeding device configured to feed the stacked sheets in the sheet tray. A light emitting device emits light toward the stacked sheets, and the emitted light includes at least two values of light. A light receiving device receives the light emitted by the light emitting device. Further, a control device detects the number of paper sheets in the stack based on a quantity of a decrease of the transmitted light emitted by the light emitting device. An image forming device is configured to form images on the sheets.

14 Claims, 11 Drawing Sheets

U.S. PATENT DOCUMENTS

| | | | |
|---|---|---|---|
| 6,153,888 | A | 11/2000 | Fournier et al. |
| 6,215,552 | B1 | 4/2001 | Acquaviva et al. |
| 6,365,889 | B1 | 4/2002 | Elgee |
| 6,373,044 | B1 | 4/2002 | Seehawer |
| 6,381,423 | B1 | 4/2002 | Eom |
| 6,568,591 | B1 | 5/2003 | Modi |
| 6,585,344 | B1 | 7/2003 | Kolodziej |
| 6,642,502 | B1 | 11/2003 | Iwaki |
| 6,725,207 | B1 | 4/2004 | Swimm |
| 6,781,111 | B1 | 8/2004 | Mukai |
| 6,794,668 | B1 | 9/2004 | Barnes |
| 6,800,868 | B1 | 10/2004 | Kawamura et al. |
| 6,804,474 | B1 | 10/2004 | Morita et al. |
| 6,817,610 | B1 | 11/2004 | Rompe |

FOREIGN PATENT DOCUMENTS

| | | | | |
|---|---|---|---|---|
| JP | 11301886 | A | * | 11/1999 |
| JP | 2000-034037 | | | 2/2000 |
| JP | 2001294344 | A | * | 10/2001 |
| JP | 2003212392 | A | * | 7/2003 |

OTHER PUBLICATIONS

Patent Abstracts of Japan, JP 59-039645, Mar. 5, 1984.
Patent Abstracts of Japan, JP 03-095481, Apr. 19, 1991.

* cited by examiner

SHEET FEEDING APPARATUS AND IMAGE FORMING APPARATUS

CROSS-REFERENCE TO RELATED APPLICATIONS

The present document is a divisional of U.S. application Ser. No. 10/403,011 filed Apr. 1, 2003 now U.S Pat. No. 7,073,789, and claims priority to Japanese Patent Application No. 2002-108753 filed in the Japanese Patent Office on Apr. 11, 2002, the entire contents of each of which are hereby incorporated by reference herein.

BACKGROUND OF THE INVENTION

1. Field of the Invention

The present invention relates to a sheet feeding apparatus and an image forming apparatus such as a copying machine, a facsimile machine, a printer, or other similar image forming apparatus.

2. Discussion of the Background

In an image forming apparatus, an apparatus detecting whether a conveyed medium includes one or more sheets is described in Japanese Patent Laid-Open No. 2000-34037. However, because this apparatus detects whether the conveyed medium includes one or more sheets, even if this apparatus is applied to a paper feeding apparatus, the actual number of the recording paper sheets cannot be detected precisely if several sheets of recording paper are on a paper tray.

Further, another background paper feed apparatus detects an approximate number of paper sheets remaining on a paper tray, for example whether there are 50 or 100 recording paper sheets on a paper tray. However, there is a problem that an inconvenience arises from the inherent inaccuracy and roughness of only approximately detecting the number of paper sheets.

Recently, and as shown in FIG. 16, an image forming apparatus such as a copier or a printer has included a large transfer belt 91 that simultaneously carries plural images G1–G5 (for a total of carrying 5 images) so that the apparatus can have a high speed operation. However, if the number of recording paper sheets on a bottom board 96 of a paper tray 95 is less than the number of images carried on the transfer belt 91 at one time, unnecessary images end up being formed on the transfer belt 91. Therefore, a waste of a toner results because the toner from the unnecessary images is not used to form images, but is only collected by a cleaning device.

For example, if there were only three recording paper sheets (P1–P3) left between the paper tray 95 and the transfer member 94 when the transfer belt 91 carried 5 images (G1–G5) as shown in FIG. 16, two images would be merely erased by a cleaning device because no recording paper sheets would be available to receive those two images. Therefore, as recognized by the present inventors, there is a need for the number of sheets to be detected precisely.

However, there are problems that a number of sheets cannot be optically detected precisely because different kinds of recording paper sheets have different transmitted light rates.

A transmitted light rate of an ordinary recording paper sheet may be equal to or less than 1.5%, but the transmitted light rate may be less than 0.1% when in particular the recording paper sheets include pieces of cardboard. This factor deteriorates measurement precision so that noise influences become large.

If a quantity of emission of a light emitting device is increased in such a case as noted above, the transmitted light rate cannot have a measurement of around 90% for, for example, an OHP (overhead projector) sheet.

SUMMARY OF THE INVENTION

It is therefore an object of the present invention to provide a novel apparatus in which a high or a low extent of a transmitted light rate can be measured, and to provide a novel apparatus that can detect a number of recording paper sheets precisely.

According to an aspect of the present invention, an image forming apparatus includes a sheet feeding apparatus, including a sheet tray configured to accommodate stacked sheets, a sheet feeding device configured to feed the stacked sheets from the sheet tray, a light emitting device configured to emit light toward the stacked sheets, and to emit light of at least two values, a light receiving device configured to receive the emitted light, and a control device configured to detect the number of sheets based on a quantity of a decrease of the transmitted light emitted by the light emitting device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
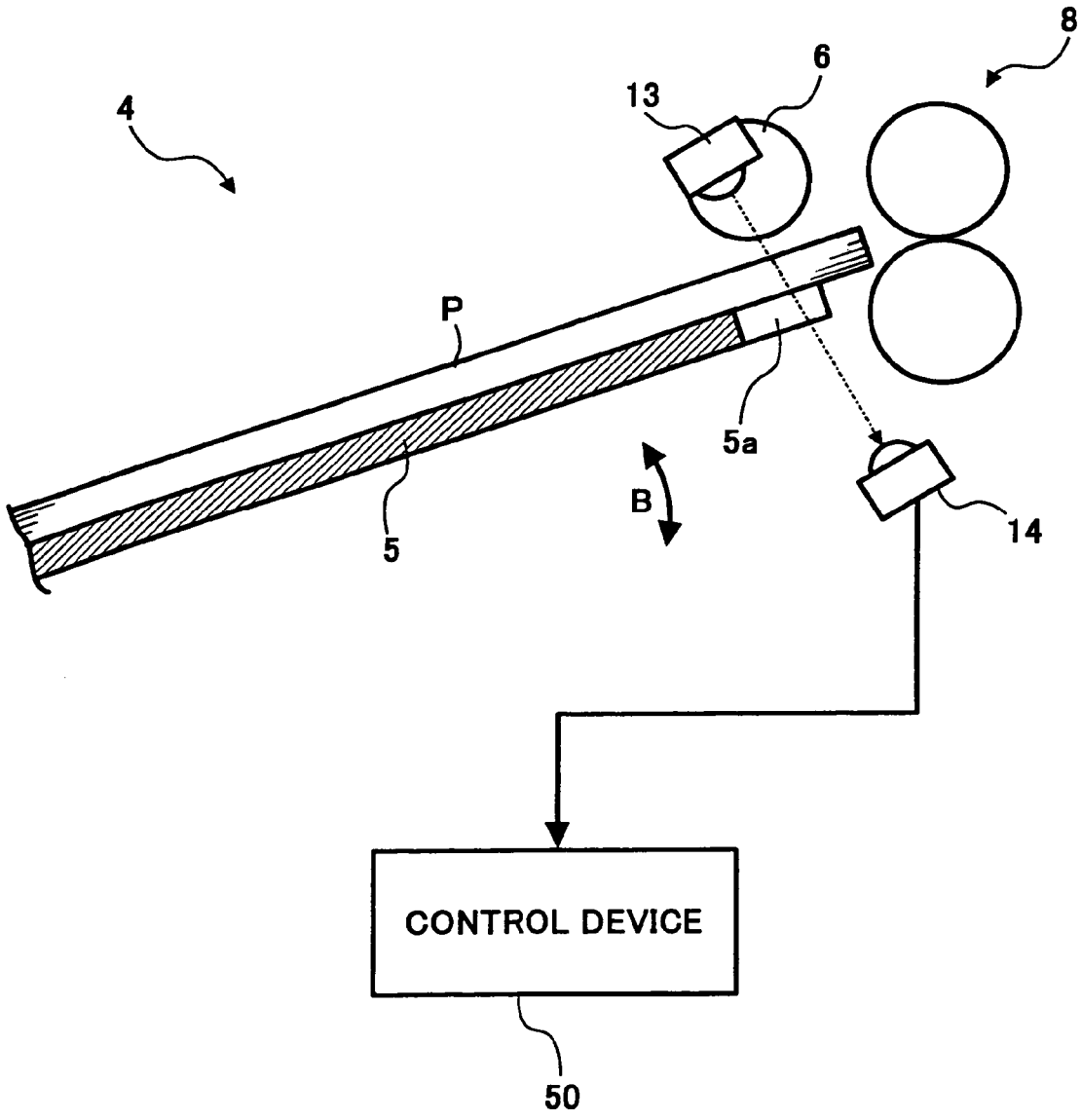
FIG. 1 is a diagram showing a sheet feeding apparatus according to one embodiment of the present invention.

Preferred embodiments of the present invention are described in detail with reference to the drawings, wherein like reference numerals designate identical or corresponding parts throughout the several views.

Figure 2:
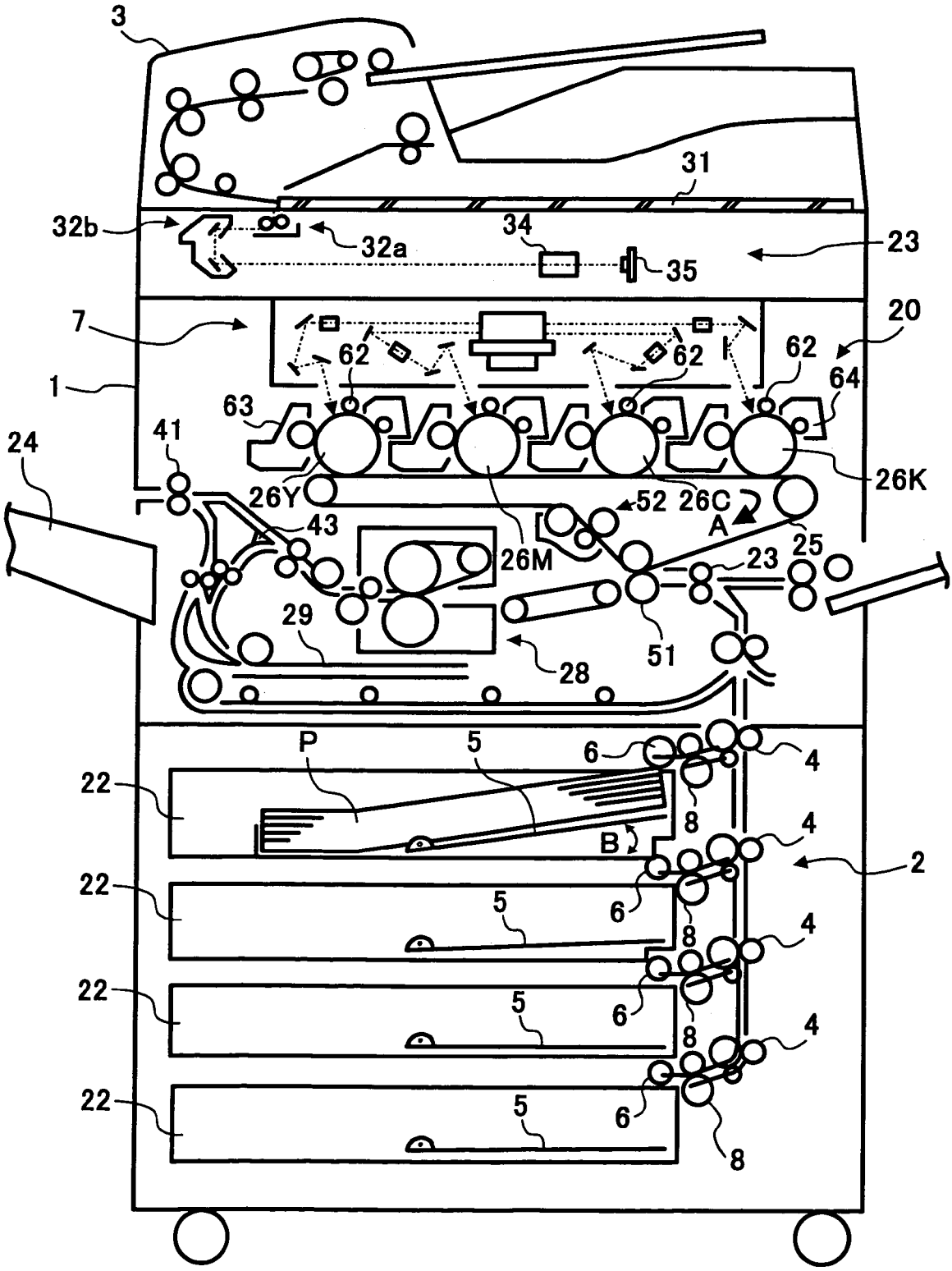
FIG. 2 is a diagram of a color image forming apparatus including the sheet feed apparatus of FIG. 1.

FIG. 1 is a diagram of a sheet feeding apparatus according to a first embodiment of the present invention. FIG. 2 is a diagram of a color image forming apparatus including the sheet feed apparatus of FIG. 1.

A color image forming apparatus shown in FIG. 2 includes an image forming device 20 located in substantially a center of a main body 1, and a paper feeding device 2 including plural paper trays 22 disposed under the image forming device 20. Of course, it is possible to add another paper feeding device.

Further, the color image forming apparatus includes a reading device 23 to read a document or manuscript, positioned above the image forming device 20, and an output storing device 24, e.g. an output tray, to receive output recording paper sheets, shown at the left side of the image forming device 20.

Transfer belt 25 is stretched between plural rollers and rotates in the direction of arrow A. Four photo-conductors 26Y, 26M, 26C, 26K, as part of developing devices 63, are disposed above the transfer belt 25. Each developing device 63 forms images by using toner and includes a charging device 62 that charges the surface of the respective photo-conductor, and a cleaning device that removes remaining toner after the toner image is transferred to the transfer belt 25, disposed around each photo-conductor.

In the upper part of the image forming apparatus 20, exposure device 7 irradiates laser light corresponding to image information of each color, and forms a latent image on each photo-conductor 26Y, 26M, 26C, 26K.

Further, a fixing device 28 is located downstream of the image forming device 20 and a registration roller 33 is located upstream of the image forming device 20. When a timing is matched with the images on the photo-conductors, the registration roller 33 conveys a paper sheet toward the photo-conductors. Thereby, toner images are transferred to the paper sheet, and then the fixing device 28 fixes the images.

Downstream of the fixing device 28, an eject roller 41 is disposed to eject a recording paper sheet that has passed through the fixing device 28. The eject roller 41 is upstream of the output storing device 24. An automatic manuscript conveyer 3 conveys a manuscript automatically on the contact glass 31 shown in FIG. 2.

When a full color copy operation starts, each photo-conductor 26Y, 26M, 26C, 26K is charged by each respective charging device 62, and then latent images on the photo-conductors are formed corresponding to toners of yellow (Y), magenta (M), cyan (C), and black (BK).

The photo-conductors 26Y, 26M, 26C, 26K have the latent images formed thereon by the exposure device 7 based on the image read by the reading device 23. Specifically, when the reading device 23 reads the image of the manuscript on the contact glass 31, reading optical bodies 32*a*, 32*b* are moved to the left and right. Then, the image signal is read by CCD 35 disposed beyond the lens 34. After the image signal read by CCD 35 is digitized, an image processing is completed. Then, a laser diode in exposure device 7 generates a light signal based on the read image signal, and each photo-conductor 26Y, 26M, 26C, 26K is accordingly exposed. Thereby, electrostatic latent images are formed on the photo-conductors.

In that operation, the light from the laser diode reaches each photo-conductor through a polygon mirror and lens system in exposure device 7. In this way, each latent image formed on each photo-conductor 26Y, 26M, 26C, 26K is developed by each of the four developing devices 63, that is, yellow (Y), magenta (M), cyan (C), and black (BK).

Firstly, a yellow toner image is transferred onto the transfer belt 25 because the belt 25 rotates in direction A. Secondly, a magenta toner image is transferred onto the transfer belt 25. Thirdly, a cyan toner image is transferred onto the transfer belt 25. Finally, a black toner image is transferred onto the transfer belt 25. As a result, the color image is formed on the transfer belt 25.

Then, when the images on the transfer belt 25 rotate to the transfer roller 51, the images transfer onto the recording paper at an appropriate timing. In this way, the color image forming apparatus forms a color image by rotating the transfer belt 25. After the color image is transferred to the paper sheet, remaining toner on the transfer belt 25 is collected by the cleaning device 52.

In a one side image forming operation, the image on the paper sheet is fixed, and then the paper sheet is output to the output storing device 24 by the eject roller 41. On the other hand, in a duplex mode, the paper sheet moves toward the duplex device 29 by a discharging path selector 43. After the paper sheet is turned over on the duplex device 29, the paper sheet is conveyed to the registration roller 33 again, and an image is then formed on the second side of the paper sheet.

Further, the paper feeding device 2 includes the paper feeding part 4. The paper feeding part 4 has a bottom board 5 on which the paper sheets are stacked, a pickup roller 6 for picking up the paper sheets by rotating in a counterclockwise direction, and a separating mechanism 8 including a feed roller and a reverse roller, which separates an individual paper sheet from the stacked paper sheets.

As shown in FIG. 1, the paper feeding device 4 includes a light emission device 13 that emits a light, and a light receiving device 14 that receives the light emitted by the light emission device 13.

A control device 50 has a function to detect the number of sheets of recording paper P on the bottom board 5 by judging a quantity of a decrease of the transmitted light when the light emission device 13 emits light toward the receiving device 14. The control unit 50 includes conventional components such as a RAM, a ROM, a CPU, an IO circuit, etc. (not shown).

The light emission device 13 can output at least two values of light (of course, it may be more than two values), i.e. light of two different amplitudes. Specifically, the light emission device 13 can emit a strong emission light and a weak emission light in an interval between appointed times. Further, the bottom board 5 has a notch 5*a* to pass the light emitted by the light emission device 13. The bottom board 5 can be rotated in direction B shown in FIGS. 1 and 2 by a motor (not shown). A lever driven by the motor pushes up the bottom board 5 and the recording paper thereby rises (not shown).

It is preferable that both of the light emission device 13 and the light receiving device 14 are fixed to the bottom board 5 so that the distance between the emission device 13 and the light receiving device 14 is always kept constant even when the bottom board 5 rises.

When the paper sheet is fed from the paper feeding part 4, the bottom board 5 rises so that the position of the pickup roller 6 is always at a level of the upper sheet of the stack of paper sheets to be fed, so that the pickup roller 6 can pick up the upper paper sheet from the stack of paper sheets. If a recording paper sheet P is inadvertently sent forth with an extra paper sheet, one of the paper sheets is separated by the separating mechanism 8 so that only one paper sheet is fed.

The recording paper sheet P is conveyed to the registration roller 33, and then the paper sheet P is stopped. After that, the paper sheet P is conveyed toward the image forming device 20 by the registration roller 33. The image forming process is performed, and then the paper sheet P goes toward the output storing device 24.

As described above, the recording paper sheet P on the bottom board 5 is positioned between the light emission device 13 and light receiving device 14. For example, as the light emission device 13, an LED element or a semiconductor laser can be utilized, although another light source may be applied. A wavelength may be infrared rays, ultraviolet rays, visible light, etc.

Figure 3:
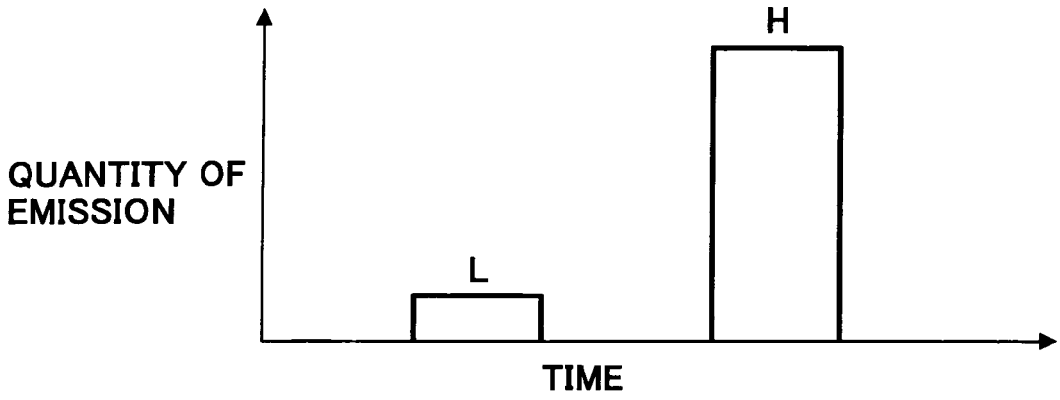
FIG. 3 is a diagram of two values of emission light output by a light emission device in the present invention.

Two values of the emission of light are repeatedly output by the light emission device 13 as shown in FIG. 3. As shown in FIG. 3, the weaker emission light L is output from the light emission device 13 first, and then the stronger emission light H is output after a predetermined time.

Further, the emission light H may have a strength of 50 times that of emission light L, for example. Of course, the actual values of the strength and weakness of the light pulses is arbitrary.

Figure 4:
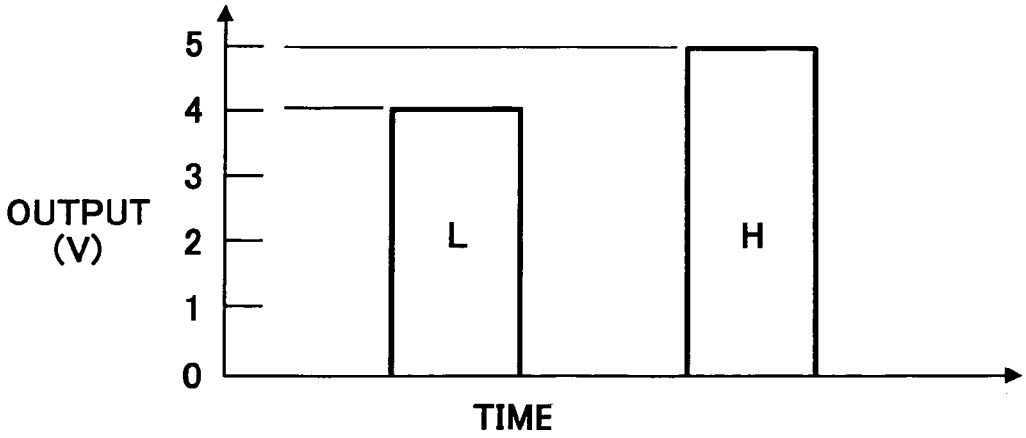
FIG. 4 is a diagram explaining that a light receiving device receives two values of emission light when there is no recording paper sheet.

FIG. 4 is a diagram showing outputs when the light receiving device 14 receives the two values of different light when there is no recording paper on the board 5. In this example the output of the light receiving device 14 in receiving the weak emission light L is 4V. On the other hand, the output of the light receiving device 14 in receiving the strong emission light H is 5V.

The reason two different output light values are provided is as follows. As discussed above an image forming device can form images on different types of sheets, for example regular paper sheets, thick cardboard sheets, or more light transmissive overhead projector (OHP) sheets. Because these different types of sheets have different light transmission properties, a single light source would not provide adequate detection properties. For example, a cardboard sheet is very thick, so utilizing just the weak emission value light L output shown in FIG. 3 would not provide adequate detection as that output light would be too significantly attenuated after passing through the cardboard sheet. At an opposite end, an OHP sheet is very light transmissive, and would require utilizing the weak emission value light L output such as shown in FIG. 3. With respect to detecting an OHP sheet number, utilizing the stronger emission value light H in FIG. 3 would not provide a proper operation as that stronger emission value light H would not be attenuated enough after passing through the OHP sheet. Thus, by utilizing two different emission value lights L, H an appropriate signal for different sheets that can be utilized in the image forming apparatus.

Figure 5:
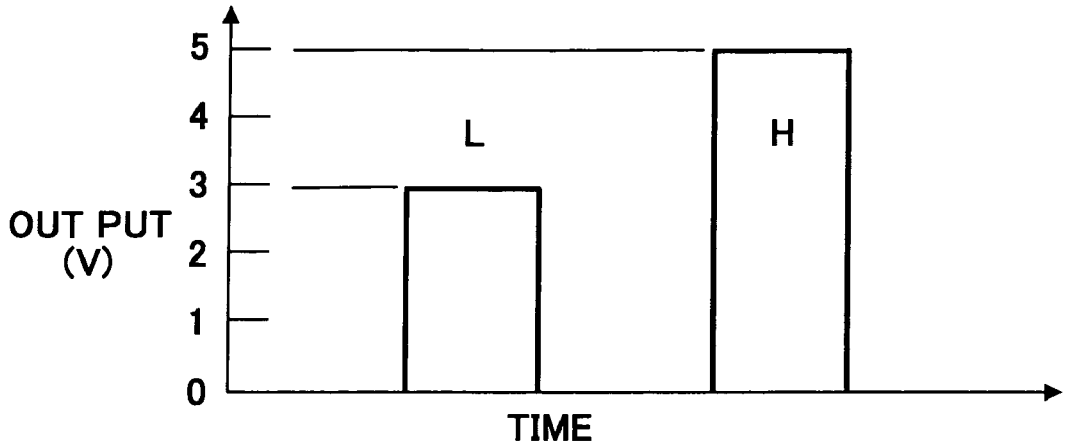
FIG. 5 is a diagram showing that the light receiving device receives two values of emission light when the light is transmitted through an OHP sheet.

FIG. 5 is a diagram showing outputs when the light receiving device 14 receives two values of different light when an OHP sheet is on the board 5, i.e. when the light is transmitted through an OHP sheet. In this example, the output of light receiving device 14 in receiving the weak emission light L may be 3V, and the output of light receiving device 14 in receiving the strong emission light H may be 5V. Because the output of the light receiving device 14 was 4V when there was no recording paper on the board 5 in the state of weak emission light L, the transmitted light rate is 75% (¾·100). However, the transmitted light rate of emission light H shown in FIG. 4 is the same as shown in FIG. 5. Therefore, as discussed above, in a situation of detecting an OHP sheet the weak emission light L is utilized.

Figure 6:
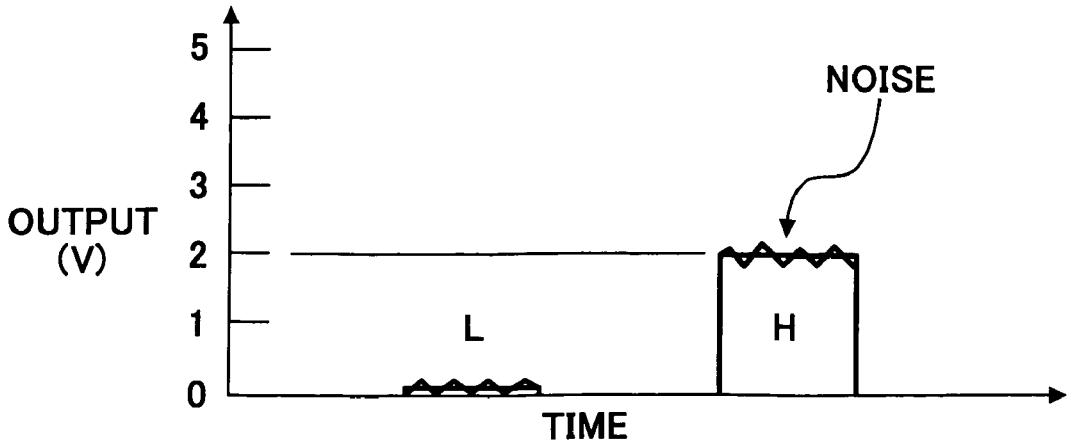
FIG. 6 is a diagram showing that the light receiving device receives two values of light when the light is transmitted through a cardboard sheet.

FIG. 6 is a diagram explaining outputs when the light receiving device 14 receives two values of different light when a cardboard sheet is on the board 5, i.e. when the light is transmitted through a cardboard sheet. In this example, the output of the light receiving device 14 in receiving the weak emission light L may be 0.04V, and the output of the light receiving device 14 in receiving the strong emission light H may be 2V. Because the output of light receiving device 14 was 4V when there was no recording paper in the state of the weak emission light L, the transmitted light rate is 1% ($^{0.04}/_{4}$·100). As described above, in this example a quantity of emission light H is 50 times a quantity of weak emission light L. Therefore, the transmitted light rate is 1% (2/(4·50)·100) in the state of the emission light H.

However, each output L, H of light receiving device 14 as shown in FIG. 6 includes noise of ±0.04V, so total output L is 0.04±0.04V. As a result, the transmitted light rate may be 0–2%.

On the other hand, when the noise is considered, the output of light receiving device 14 may become 2±0.04V in the emission light H, and the error rate is ±0.02% (($^{0.04}/_{4}$·50)·100). As a result, the transmitted light rate is 0.08–1.02% or the precision improves. Therefore, in the context of detecting a thicker cardboard sheet the stronger emission light H is utilized.

As mentioned above, the transmitted light rate of a recording paper employed in an image forming apparatus is equal to or less than 1.5% as above. If the recording paper sheets through which the laser light is transmitted includes several pieces of cardboard, a measurement precision is reduced by an influence of noise so that the transmitted light rate becomes very small with less than 0.1%.

However, according to this paper feeding apparatus, utilizing two values of light makes it possible for the transmitted light rate to be measured even if the rate is high or low. Therefore, the number of sheets can be detected precisely. As a consequence, waste of a toner can be prevented.

Figure 7:
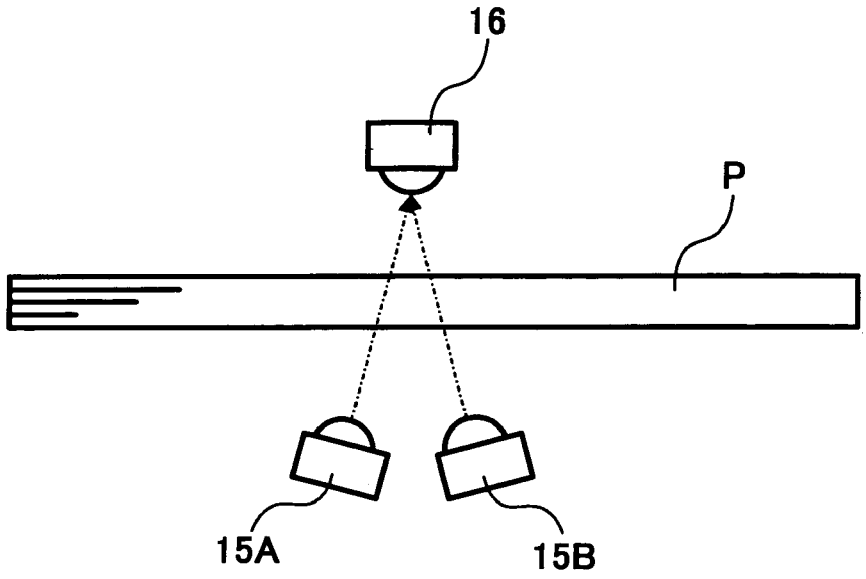
FIG. 7 is a diagram showing a light emission device detecting the number of sheets in a second embodiment of the present invention.

FIG. 7 is a diagram showing a light emission device detecting the number of sheets in a second embodiment of the present invention.

A paper feeding apparatus by this embodiment is different from the paper feed apparatus described in FIG. 1. The different point is that the light emitting device includes light emission devices 15A, 15B (which can be more than two). The light emission device 15A outputs the strong emission light (emission light H of FIG. 3), and the light emission device 15B outputs the weak emission light (emission light L of FIG. 3).

In the first embodiment it is necessary for the light emitting device 13 to change an emission of a light pulse between the two values of the strong emission light H and the weak emission light L as shown in FIG. 1. The second embodiment need not change the output of a light source since two separate light sources are utilized. Therefore, the detecting time can be shortened when compared with that in the first embodiment.

Figure 8:
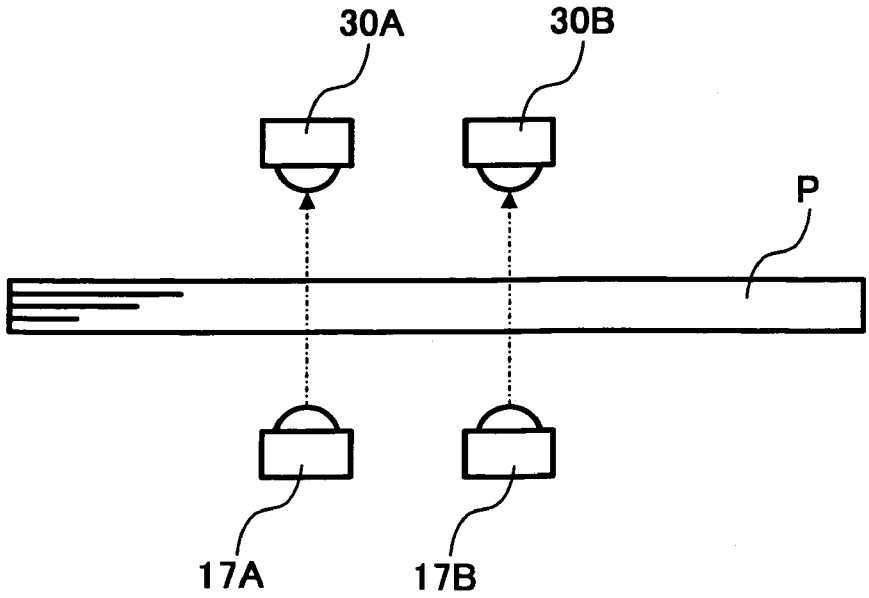
FIG. 8 is a diagram showing a light emission device detecting a number of sheets in a third embodiment of the present invention.

FIG. 8 is a diagram showing a light emission device detecting a number of sheets in a third embodiment of the present invention. A paper feeding apparatus in this embodiment is different from the paper feeding apparatus described in FIG. 7. This paper feeding apparatus has two light emission devices 17A, 17B and two light receiving devices 30A, 30B. The light receiving device 30A receives the strong emission light H that the light emission device 17A emits, and the light receiving device 30B receives the weak emission light L that the light emission device 17B emits. Therefore, the detecting time can be even shorter when compared with the second embodiment.

Figure 9:
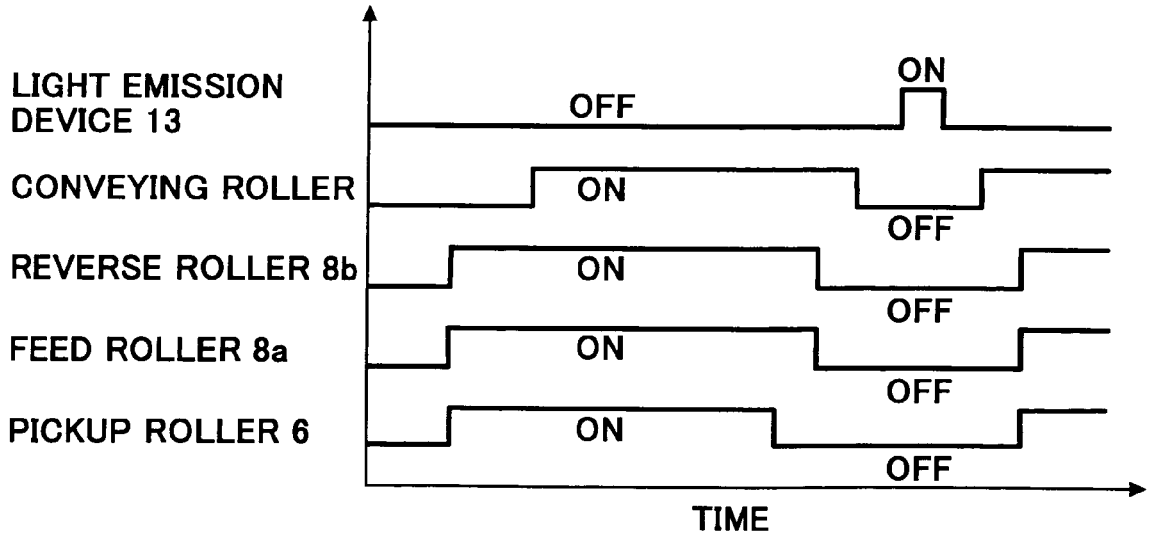
FIG. 9 is a timing diagram showing a movement timing of various parts to explain a fourth embodiment of the present invention.

FIG. 9 is a timing diagram that shows a movement timing of different parts to explain a fourth embodiment of the present invention. When a conveying roller, a reverse roller of the roller pair 8, and a feed roller of the roller pair 8 rotate, vibration occurs. Therefore, the light emission device 13 of the paper feeding apparatus of this embodiment emits a light when these rollers 8 do not rotate, i.e. when these rollers 8 are in a standstill state. Therefore, the transmitted light rate can be measured more stably.

Figure 10:
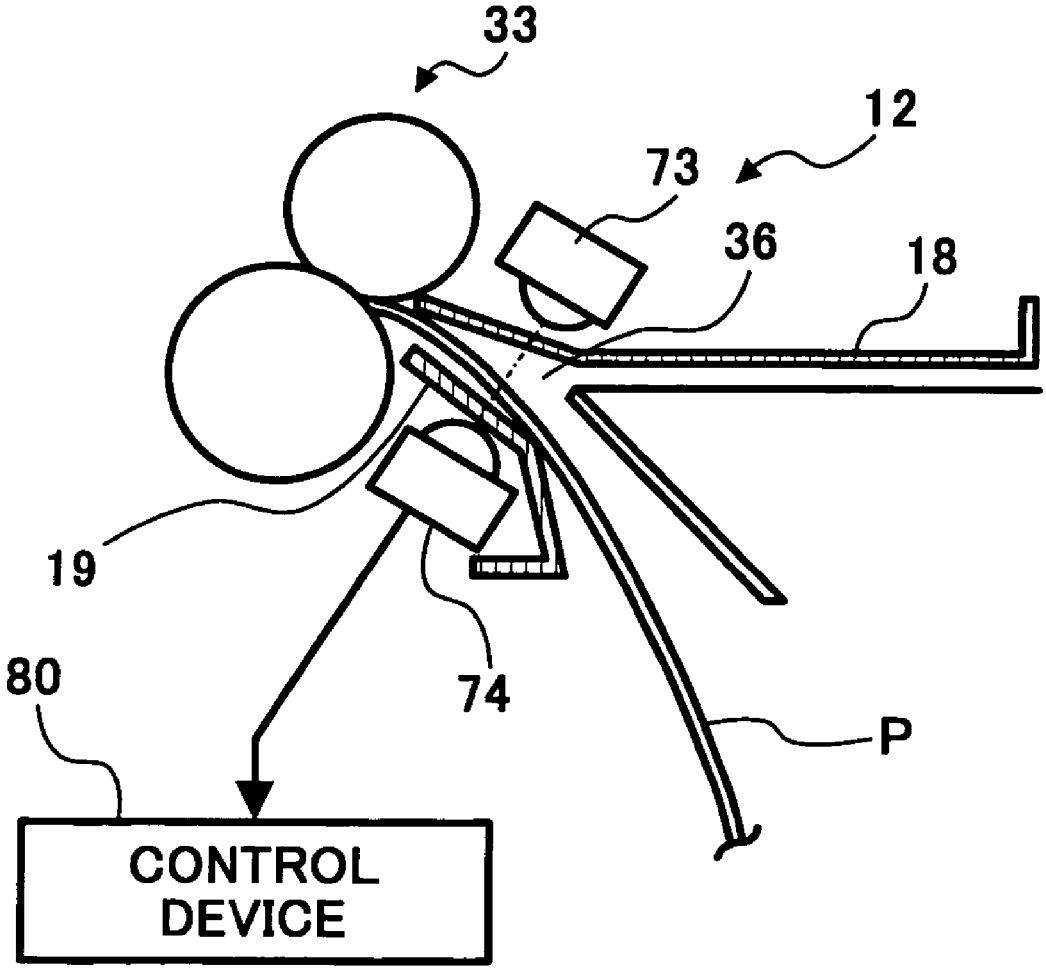
FIG. 10 is a diagram showing a component detecting a number of sheets in a fifth embodiment of the present invention.

FIG. 10 is a diagram showing a component detecting a number of sheets in a fifth embodiment of the present invention. This embodiment is different from the previous embodiments in utilizing an additional light receiving device 73 and light emission device 74, and in the location of the light receiving device 73 and the light emission device 74. Specifically, these devices 73,74 are located near the registration roller 33. A control unit 80 detecting a quantity of a decrease of the transmitted light is also located near the registration roller 33. Further, this embodiment also utilizes the light emission device 13 and light receiving device 14 to detect the number of sheets of a recording paper on the bottom board 5 the same as in the paper feeding apparatus shown in FIG. 1. The light emission device 73 and the light receiving device 74 detect the transmission rate when the paper sheet P stops at the registration roller 33. The light emission device 73 and light receiving device 74 are fixed rigidly to guiding boards 18, 19 respectively. Therefore, the distance between the light emission device 73 and the light receiving device 74 is always kept constant.

Further, the control device 80 has a function to detect the number of recording paper sheets P on the bottom board 5 by judging a quantity of a decrease of the transmitted light when the light emission device 13 emits light toward the receiving device 14. As described above, because the detecting position is near the registration roller 33 located downstream of the separating device, the light receiving device 74 can detect the transmitted rate of one paper sheet precisely.

Therefore, the number of sheets of recording paper on the bottom board 5 can be measured as the transmitted light rate of the devices 73, 74 in comparison with the transmitted light rate of the devices 13, 14 precisely. Further, even if a recording paper sheet such as a cardboard sheet, tissue paper, colored paper, etc., a difference of the transmitted light rates can be detected precisely. According to this paper feeding apparatus, utilizing two values of light makes it possible for the transmitted light rate to be measured even if the light transmission rate is high or low.

The further embodiments discussed now with respect to FIGS. 11–14 essentially combine the different embodiments of FIGS. 7–9 with the additional structure of FIG. 10, as now discussed in further detail below.

Figure 11:
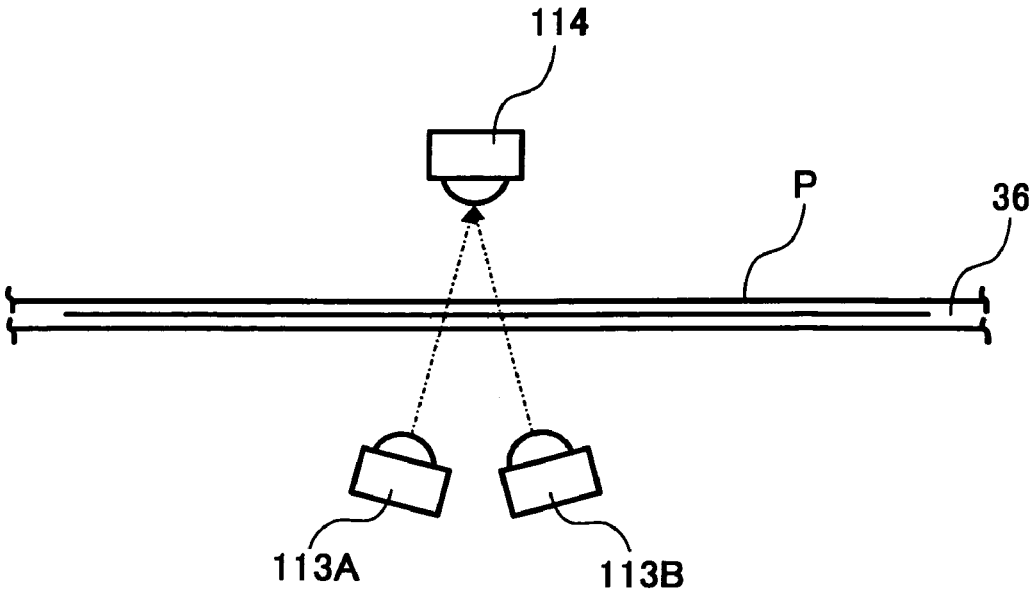
FIG. 11 is a diagram showing a component detecting a recording paper of a conveyance sheet in a sixth embodiment of the present invention.

FIG. 11 is a diagram showing a component detecting a recording paper sheet of a paper sheet in a sixth embodiment of the present invention.

A paper feeding apparatus by this embodiment is different from the paper feeding apparatus described in FIG. 10. The different point is that a light emitting means includes the light emission device 113A, 113B (more than two can be applied). The light emission device 113A outputs a strong emission light (emission light H of FIG. 3), and the light emission device 113B outputs a weak emission light (emission light L of FIG. 3).

In the fifth embodiment it is necessary for the light emitting device to change an emission of a light pulse between the two values of the strong emission light H and the weak emission light L as shown in FIG. 10. The sixth embodiment need not change the output of a light source since two separate light sources are utilized. Therefore, the detecting time can be shortened when compared with that in the fifth embodiment.

Figure 12:
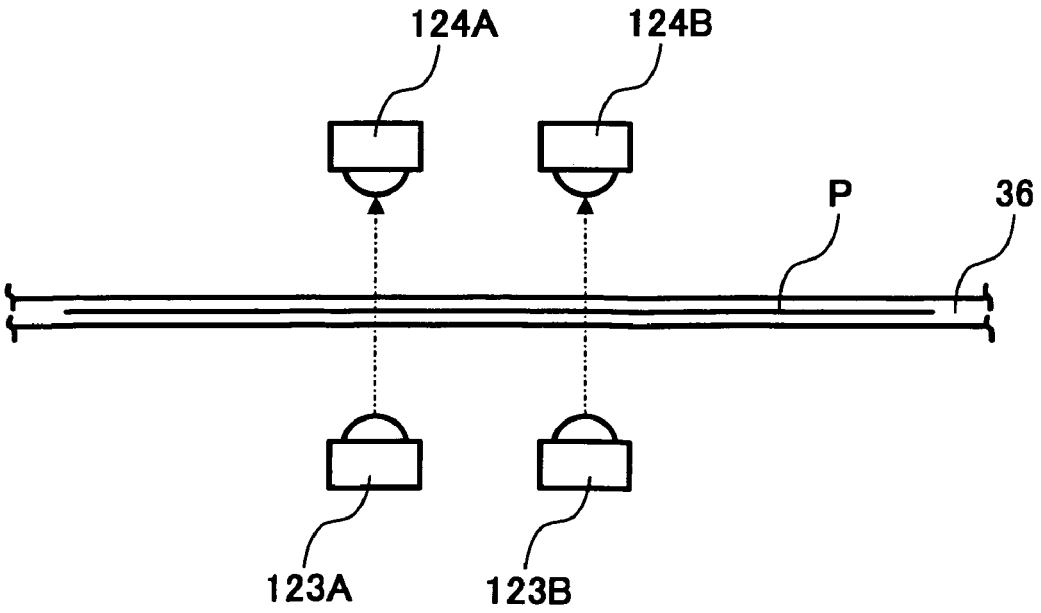
FIG. 12 is a diagram showing a light emission device detecting a number of recording paper sheets in a seventh embodiment of the present invention.

FIG. 12 is a diagram showing a light emission device detecting a number of sheets in a seventh embodiment of the present invention. A paper feeding apparatus in this embodiment is different from the paper feeding apparatus described in FIG. 11. This paper feeding apparatus has two light emitting devices 123A, 123B and two light receiving devices 124A, 124B. The light receiving device 124A receives the strong emission light H that the light emission device 123A emits, and the light receiving device 124B receives the weak emission light L that the light emission device 123B emits. Therefore, the detecting time can be even further shortened when compared with the sixth embodiment.

Figure 13:
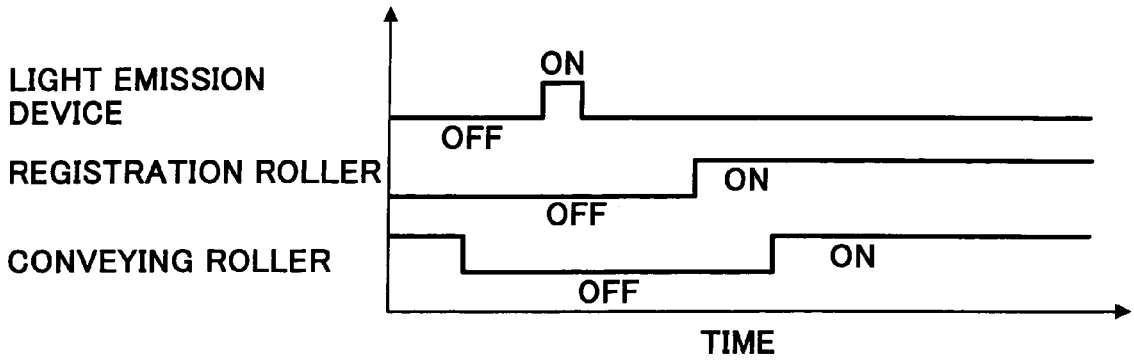
FIG. 13 is a timing diagram showing a movement timing of various parts to explain an eighth embodiment of the present invention.

FIG. 13 is a timing diagram showing a movement timing of different parts to explain an eighth embodiment of the present invention. When the registration roller 33 and the conveying roller rotate, vibration occurs. Therefore, the light emission device 13 of the paper feeding apparatus of this embodiment emits light when these rollers do not rotate, i.e. when these rollers are in a standstill state. Therefore, the transmitted light rate can be measured more stably.

Figure 14:
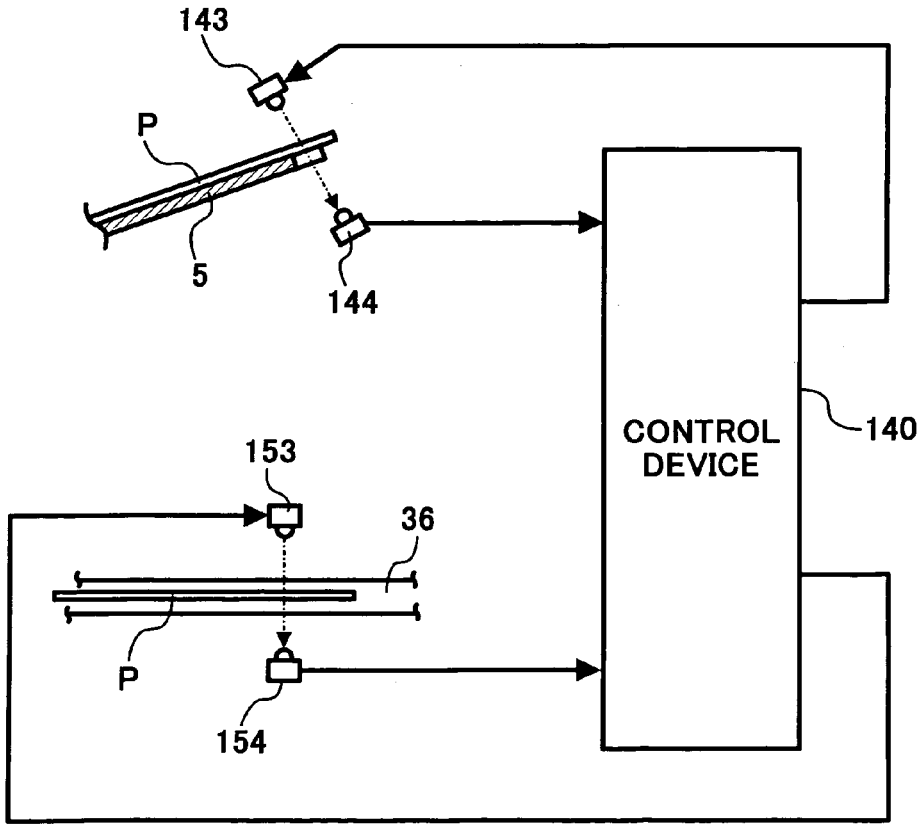
FIG. 14 is a diagram showing a ninth embodiment of the present invention.

FIG. 14 is the diagram showing a ninth embodiment of the present invention. A control device 140 has a function to detect the number of sheets of recording paper P when the light emission devices 143, 153 emit light toward the receiving devices 144, 154. The control unit 50 includes a RAM, a ROM, a CPU, an IO circuit, etc. (not shown).

Figure 15:
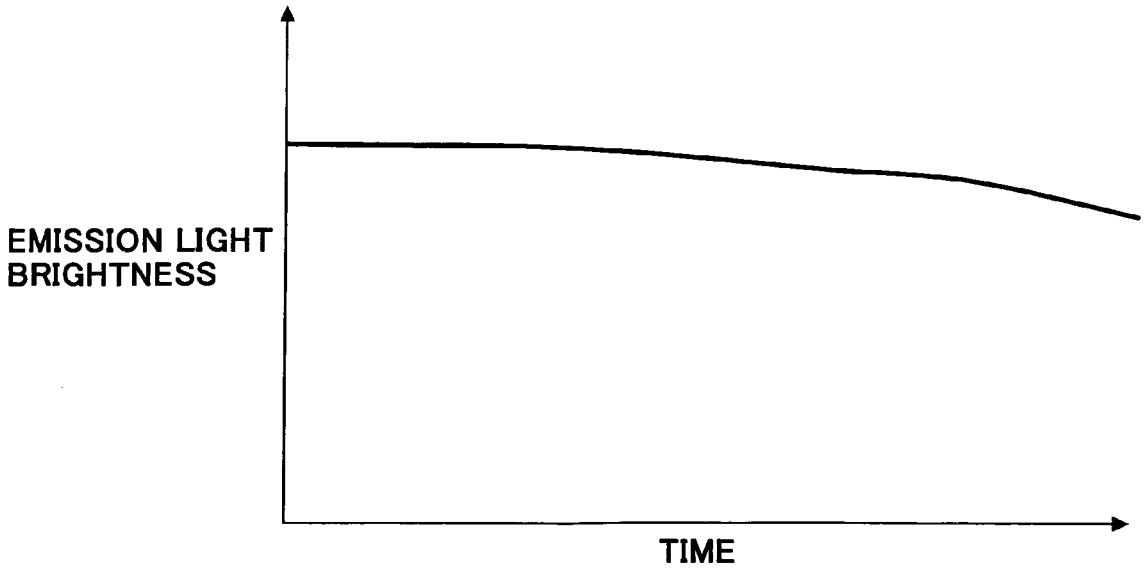
FIG. 15 is a diagram showing a relationship between time and brightness.
Figure 16:
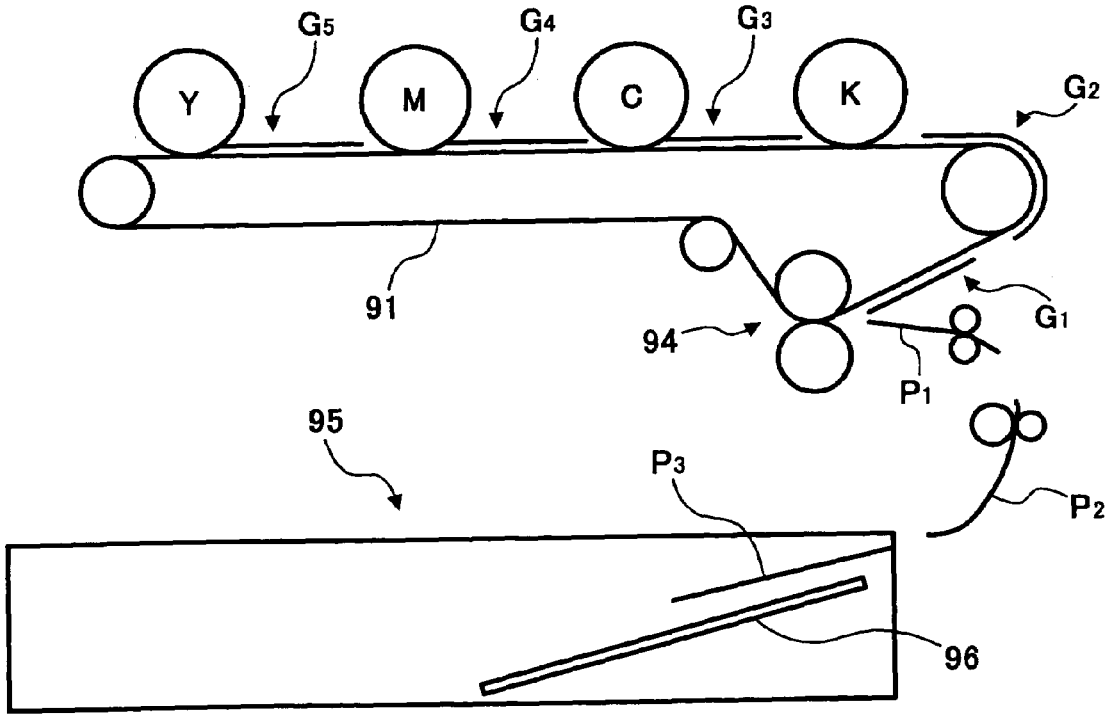
FIG. 16 is a diagram showing a background art structure.

Moreover, the emission of light brightness of an LED as a light source deteriorates as shown in FIG. 15 with the advance of time by using the light emission device 143, 153 (quantity of light deterioration over time). For example, if an output of the light emission device was 4V when a light receiving device received light without an intermediary of a paper, the output may reduce to 3.5V over time.

Therefore, the controlling device 140 compensates the output of the light emission device 143, 153 to keep the output to that at factory shipment (initial output). As a consequence, this embodiment can detect the number of the paper precisely.

The different embodiments as discussed above may operate most effectively to determine, as an example, up to four paper sheets of various kinds. In the context of a device in which a transfer belt carries five different images at a same time, appropriately detecting up to four paper sheets ensures that no wasteful toner images are formed on the transfer belt without having an adequate number of sheets on the paper tray to receive those images.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A sheet feeding apparatus, comprising:

a sheet tray configured to accommodate stacked sheets;

a sheet feeding device configured to feed the stacked sheets from the sheet tray;

a separation device configured to separate an individual sheet from the stacked sheets;

a first light emitting device configured to emit first light toward the stacked sheets, and to emit first light of at least two intensities;

a first light receiving device configured to receive the first light emitted by the first light emitting device;

a first control device configured to detect a number of sheets based on a quantity of a decrease of the transmitted light emitted by the first light emitting device;

a second light emitting device configured to emit second light toward the individual sheet after the separation device separates the individual sheet, and to emit second light of at least two intensities;

a second light receiving device configured to receive the second light emitted by the second light emitting device; and a second control device configured to detect a quantity of a decrease of the individual sheet based on a quantity of a decrease of the transmitted light emitted by the second light emitting device.

2. The sheet feeding apparatus of claim 1, wherein the first light emitting device includes two light emitting elements.

3. The sheet feeding apparatus of claim 2, wherein the first light receiving device includes two light receiving elements.

4. The sheet feeding apparatus of claim 1, wherein at least one of the first and the second light emitting device emits light when the sheet feeding device is in a standstill state.

5. The sheet feeding apparatus of claim 1, wherein the at least one of the first and the second control device compensates for an output of at least one of the first and the second light emission device to maintain an initial output.

6. The sheet feeding apparatus of claim 1, wherein the first control device and the second control device are a same control device.

7. An image forming apparatus, comprising:

a sheet tray configured to accommodate stacked sheets;

a sheet feeding device configured to feed the stacked sheets from the sheet tray;

a separation device configured to separate an individual sheet from the stacked sheets;

a first light emitting device configured to emit first light toward the stacked sheets, and to emit first light of at least two intensities;

a first light receiving device configured to receive the first light emitted by the first light emitting device;

a first control device configured to detect a number of sheets based on a quantity of a decrease of the transmitted light emitted by the first light emitting device;

a second light emitting device configured to emit second light toward the individual sheet after the separation device separates the individual sheet, and to emit second light of at least two intensities;

a second light receiving device configured to receive the second light emitted by the second light emitting device;

a second control device configured to detect a quantity of a decrease of the individual sheet based on a quantity of a decrease of the transmitted light emitted by the second light emitting device;

a third control device configured to detect a quantity of a decrease of the transmitted light emitted by the second light emitting device; and an image forming device configured to form images on the sheets.

8. A sheet feeding apparatus, comprising:

sheet stacking means for accommodating stacked sheets;

sheet feeding means for feeding the stacked sheets from the sheet stacking means;

separation means for separating an individual sheet from the stacked sheets;

first light emitting means for emitting first light toward the stacked sheets, and for emitting first light of at least two intensities;

first light receiving means for receiving the first light emitted by the first light emitting device;

first control means for detecting a number of sheets based on a quantity of a decrease of the transmitted light emitted by the first light emitting means;

second light emitting means for emitting second light toward the individual sheet after the separation means separates the individual sheet, and for emitting second light of at least two intensities;

second light receiving means for receiving the second light emitted by the second light emitting means; and second control means for detecting a quantity of a decrease of the individual sheet based on a quantity of a decrease of the transmitted light emitted by the second light emitting means.

9. The sheet feeding apparatus of claim 8, wherein the first light emitting means includes two light emitting source means.

10. The sheet feeding apparatus of claim 9, wherein the first light receiving means includes two light receiving means.

11. The sheet feeding apparatus of claim 8, wherein at least one of the first and the second light emitting means emits light when the sheet feeding means is in a standstill state.

12. The sheet feeding apparatus of claim 8, wherein the at least one of the first and the second control means compensates for an output of at least one of the first and the second light mission means to maintain an initial output.

13. The sheet feeding apparatus of claim 8, wherein the first control means and the second control means are a same control means.

14. An image forming apparatus, comprising:

sheet stacking means for accommodating stacked sheets;

sheet feeding means for feeding the stacked sheets from the sheet stacking means;

separation means for separating an individual sheet from the stacked sheets;

first light emitting means for emitting first light toward the stacked sheets, and for emitting first light of at least two intensities;

first light receiving means for receiving the first light emitted by the first light emitting means;

first control means for detecting a number of sheets based on a quantity of a decrease of the transmitted light emitted by the first light emitting means;

second light emitting means for emitting second light toward the individual sheet after the separation means separates the individual sheet, and for emitting second light of at least two intensities;

second light receiving means for receiving the second light emitted by the second light emitting means;

second control means for detecting a quantity of a decrease of the individual sheet based on a quantity of a decrease of the transmitted light emitted by the second light emitting means;

third control means for detecting a quantity of a decrease of the transmitted light emitted by the second light emitting means; and image forming means for forming images on the sheets.

* * * * *